United States Patent [19]

Blase et al.

[11] Patent Number: 4,847,943

[45] Date of Patent: Jul. 18, 1989

[54] LIQUID EXTRACTION SURFACE CLEANING APPARATUS

[75] Inventors: Michael R. Blase; Henry J. Rosendall; Gordon W. Goodrich, all of Grand Rapids, Mich.

[73] Assignee: Bissell, Inc., Grand Rapids, Mich.

[21] Appl. No.: 180,189

[22] Filed: Apr. 11, 1988

Related U.S. Application Data

[62] Division of Ser. No. 28,613, Mar. 20, 1987.

[51] Int. Cl.[4] ..... A47L 7/00

[52] U.S. Cl. ..... 15/352; 15/353; 15/410; 55/216

[58] Field of Search ..... 15/321, 353, 352; 55/216

[56] References Cited

U.S. PATENT DOCUMENTS

| | | | |
|---|---|---|---|
| 2,719,596 | 10/1955 | Kent et al. | 55/216 |
| 2,867,231 | 1/1959 | Gerstmann | 15/353 X |
| 2,989,769 | 6/1961 | Houser | 15/353 |
| 3,165,774 | 1/1965 | Barba | 15/353 X |
| 3,180,071 | 4/1965 | Nolte | 15/353 X |
| 3,490,208 | 1/1970 | Meyer et al. | 15/353 X |
| 3,720,977 | 3/1973 | Brycki | 15/321 |
| 3,821,830 | 7/1974 | Sundheim | 15/321 |
| 3,921,250 | 11/1975 | Jerabek | 15/353 |
| 4,586,208 | 5/1986 | Trevarthen | 15/321 X |
| 4,739,535 | 4/1988 | Schuld et al. | 15/315 |

*Primary Examiner*—Chris K. Moore

*Attorney, Agent, or Firm*—Price, Heneveld, Cooper DeWitt & Litton

[57] ABSTRACT

A liquid extraction surface cleaning apparatus has an upwardly opening recovery tank and a top for the tank which contains a suction fan having a suction inlet opening into the tank. A wand connects to a source of cleaning liquid and has a dispensing and pickup head that deposits liquid on the surface to be cleaned in response to actuation of a control valve and picks up dirty fluid. A water and air separator has an arcuate surface transverse of the flow path of the air and spent liquid which gently separates them into separate streams by diverting the cleaning liquid laterally away from the air stream. A shutoff valve for preventing recovered liquid in the tank from entering the suction fan is mounted in the recovery tank rather than to the suction inlet to avoid dripping dirty liquid onto the floor when the cover is removed. A handle is mounted internal the tank and additionally serves to strengthen the tank sidewalls.

10 Claims, 6 Drawing Sheets

FIG. 9
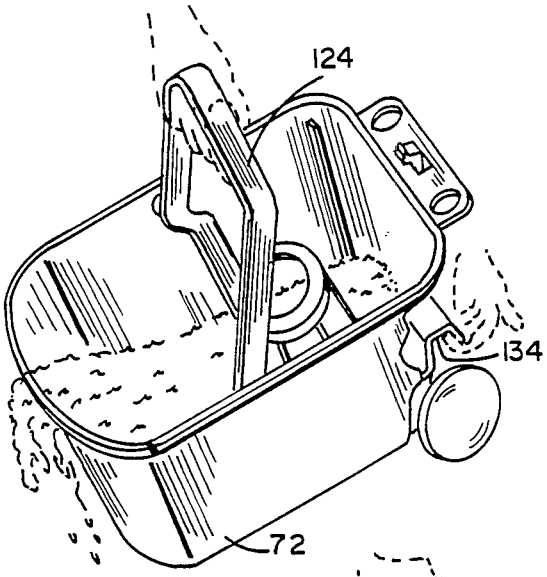
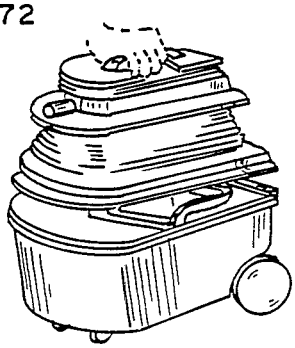
FIG. 11
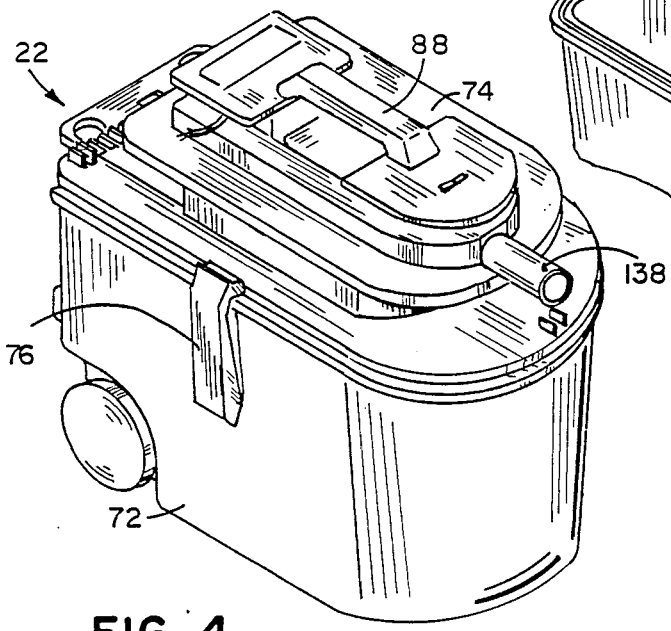
FIG. 4
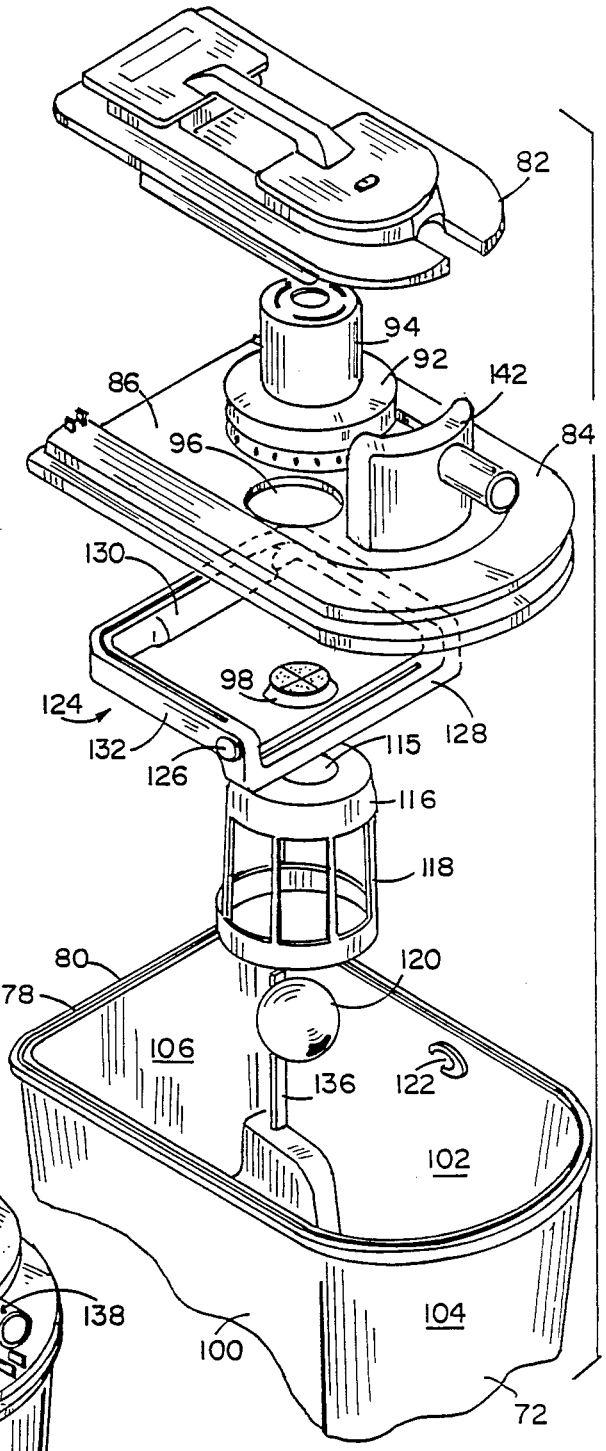
FIG. 8

LIQUID EXTRACTION SURFACE CLEANING APPARATUS

This is a divisional of co-pending application Ser. No. 07/028,613 filed on Mar. 20, 1988.

BACKGROUND OF THE INVENTION

This invention relates to surface cleaning apparatus and in particular to such apparatus of the type that utilizes a liquid to clean a carpet or like surface. A typical fluid extraction surface cleaning apparatus has a container for holding a cleaning liquid, such as a diluted detergent, a pump to dispense the liquid onto the surface and a brush, or other means to work the liquid on the surface to remove the dirt. A powerful suction device picks up the liquid through a nozzle and deposits it in a recovery tank.

Such devices have only attained limited use because the above described components have been costly to manufacture and have resulted in a large, heavy package. This bulky package has made such devices difficult to set up and operate and messy to empty of spent fluid and clean up after use. Further, they require a chemical defoamant be put in the recovery tank to prevent the suction from rendering the spent cleaning liquid into objectional foam in the liquid recovery tank.

Further, even when chemical defoamants are used in the detergent solutions or in the recovery tank itself, foam buildup in the recovery tank is a problem. Foam buildup prematurely closes the float valve typically used in such devices to prevent water from entering the suction fan.

SUMMARY OF THE INVENTION

In one aspect of the present invention, defoaming means is provided in the conduit means between the pickup nozzle and the suction means which includes a water and air separator chamber of a lateral cross-sectional area greater than the lateral cross-sectional area of the orifice opening into the separator chamber The separator chamber also includes a first surface opposite the inlet orifice which slopes laterally away from the orifice whereby as air and water impinge the first surface, water flows on the surface away from the orifice and away from the central air flow path through the separator chamber This tends to keep liquid from being entrained or reentrained in the air stream as the air passes through the separator chamber and down into the recovery tank.

These and other objects, advantages and features of the invention will be more fully understood and appreciated by reference to the written specification and appended drawings.

BRIEF DESCRIPTION OF THE DRAWINGS

FIG. 4 is a perspective view of the canister assembly portion of the apparatus;

FIG. 8 is an exploded perspective view showing the components in the canister assembly;

FIG. 9 is a perspective view of the recovery tank being emptied of spent liquid;

FIG. 11 is a perspective view of the canister assembly with its top separated from its recovery tank;

DESCRIPTION OF THE PREFERRED EMBODIMENT

A. General Description

Figure 1:
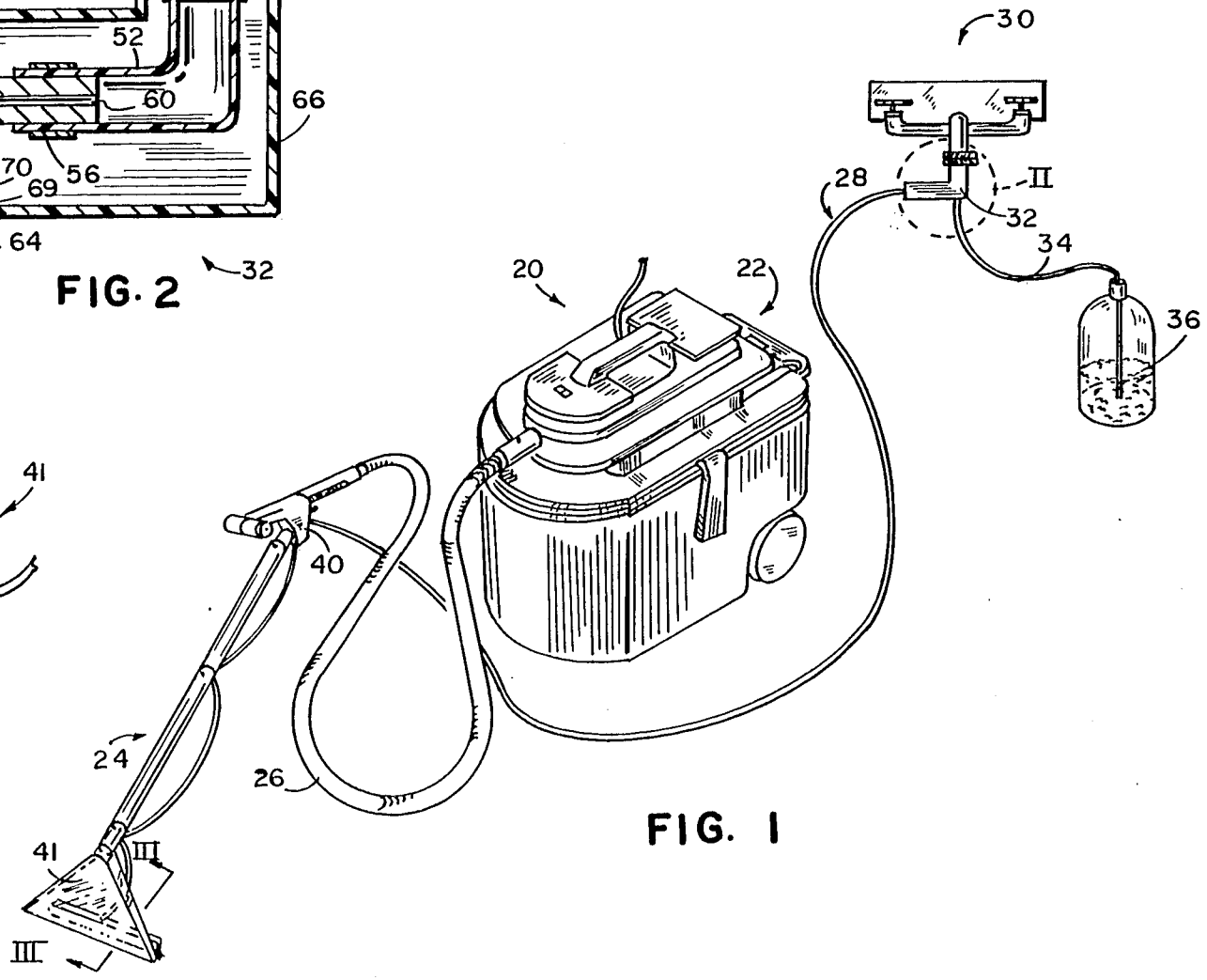
FIG. 1 is a perspective view of a liquid extraction surface cleaning apparatus according to the invention.

Referring now specifically to the drawings, and the illustrative embodiments depicted therein, a liquid extraction surface cleaning apparatus 20 is shown in FIG. 1 fully assembled and ready for use. Cleaning apparatus 20 includes a canister assembly 22 having a suction fan 92 and motor 94 (FIG. 7) mounted over a recovery tank 72, a wand assembly 24 having a dispensing and pickup head 41 for contacting the surface to be cleaned, a vacuum hose 26 connected between the wand assembly and the canister assembly, and a fluid hose 28 connected between the wand assembly and a faucet, shown at 30.

Figure 7:
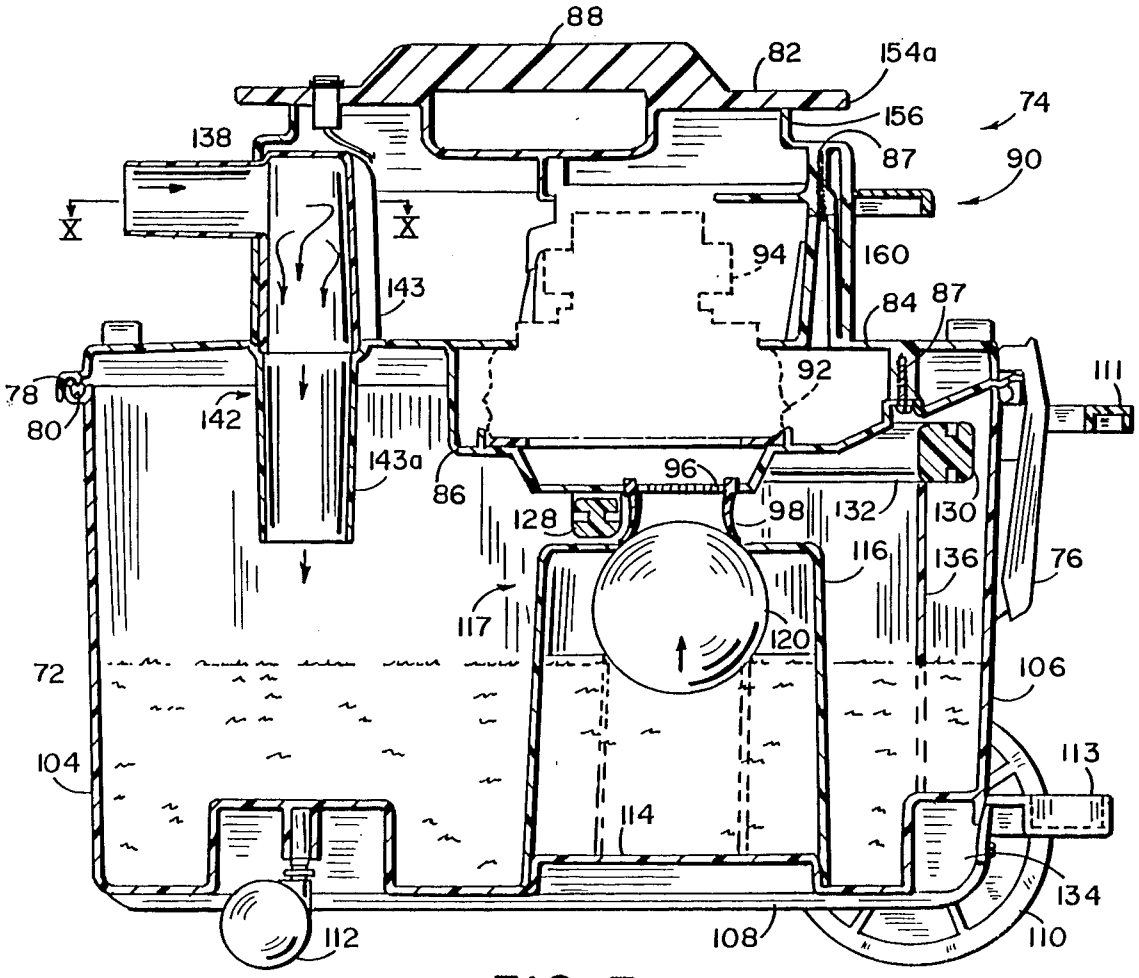
FIG. 7 is a sectional side elevational view taken along the lines 7—7 in FIG. 5.
Figure 10:
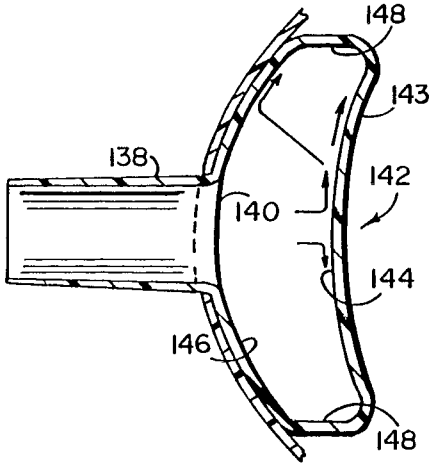
FIG. 10 is a sectional top plan view along the lines 10—10 in FIG. 7.

A vacuum hose 26 connects the wand assembly 24 to a water and air separator 142 which has an arcuate surface transverse to the flow path of the air and spent liquid, to gently separate them into separate streams by diverting the cleaning liquid laterally away from the stream of air (FIGS. 7 and 10). A shutoff valve 117 (FIG. 7) for preventing recovered liquid in the tank from entering suction fan 92 is mounted in recovery tank 72 rather than to the suction inlet of fan 92. As a result, the dirty spent fluid that tends to cover such a valve will stay in tank 72 when the cover 74 is removed to empty the tank, rather than drip onto the floor as with prior devices.

To reduce weight tank 72 is made of a lightweight plastic material. Such a tank, particularly one having planar opposing sidewall members, tends to easily distort out of shape, especially when lifted by the sidewalls and when filled with liquid. To impart internal strength to tank 72, while providing a convenient means for emptying tank 72 of spent liquid, the invention advantageously has a handle member 124 (FIG. 9) that spans the opposing sidewalls and serves to both strengthen the walls and provide a handle for lifting the tank for emptying. In the preferred embodiment, handle member 124 is rotatably mounted between a use position in which it extends above the tank opening and a storage position in which it is completely concealed within the tank during the cleaning process (compare FIGS. 8 and 9).

The canister top cover 74 has first and second concentric spools 150 and 152 for wound storage of the power cord and the fluid hose, respectively. During the cleaning process, the apparatus is connected to a faucet which may be located a great distance from the surface to be cleaned. It is, therefore, necessary to provide the apparatus with a lengthy fluid hose 28. Both ends of the hose must be accessible in order to operate the apparatus. However, it is not always necessary to unwind the entire fluid hose. For instance, in order to clean a surface close to a faucet it would be convenient to leave most of the fluid hose wound on the second spool 152. To allow the user to selectively access both ends of the hose while allowing the hose to be partially stored on its spool, spool 152 is provided with means to facilitate such selective access.

Figure 15:
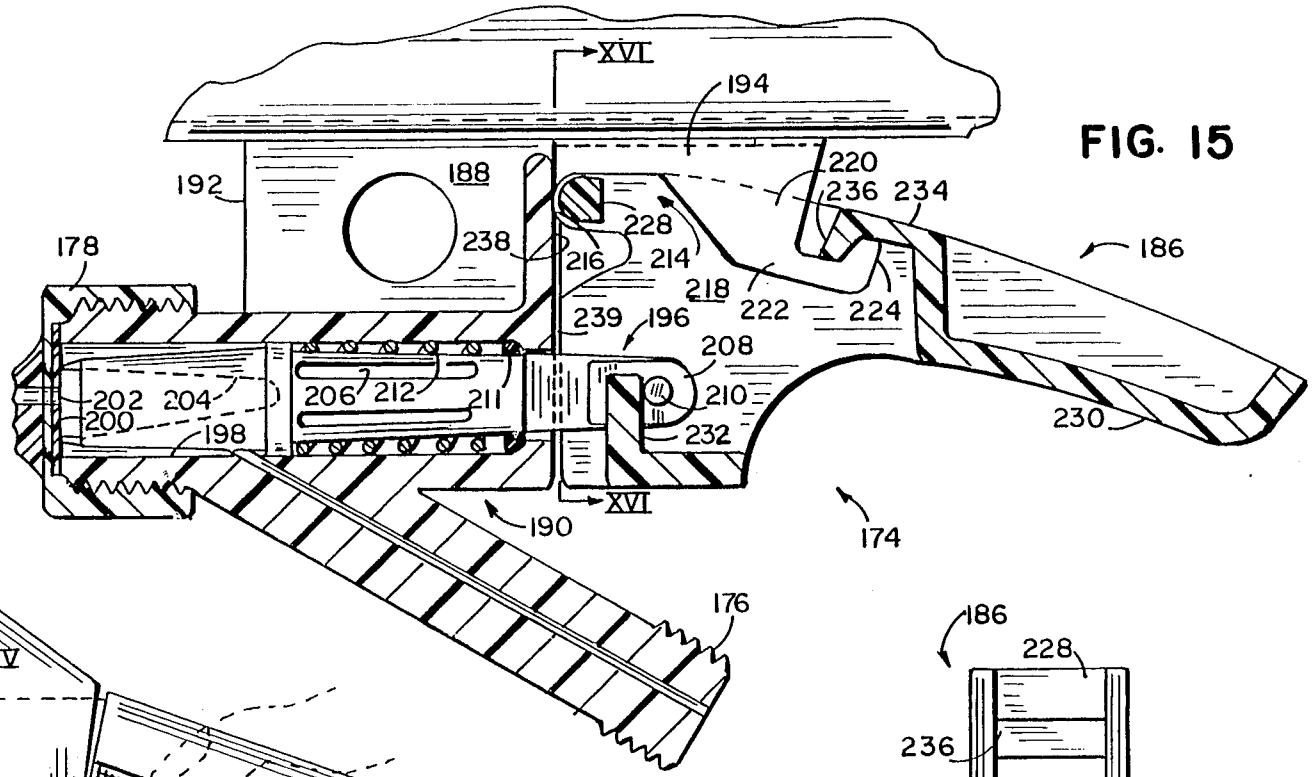
FIG. 15 is an enlarged sectional side elevational view along the lines 15—15 in FIG. 14.

The user-operable liquid dispensing control valve assembly 174 on wand 24 includes valve 190 activated by trigger 186 (FIG. 15). Valve stem 206 longitudinally reciprocates in valve 190 between an open and closed position and is biased to the closed position. Trigger 186 has a laterally oriented pin 228 that is pivotally received within a throat 214 on a base 188 attached to wand 24. A pair of opposing, interlocking flanges 222 and 234 on the base and trigger member cooperate with the attachment means and the pin to keep the trigger assembled to the base and to provide a rugged, smooth-operating mechanism. The control valve is almost entirely plastic and can be assembled without fasteners. However, once assembled, it cannot be accidentally disassembled.

Fluid hose 28 has a hookup member 32 at one end for connection to faucet 30. A suction tube 34 extends from hookup member 32 into a detergent bottle 36 that may be placed in a sink associated with faucet 30. Hose 28 is connected to hookup member 32 at one end and to a fluid control valve 40 on ward assembly 24 at the opposite end.

To clean a surface, water from faucet 30 is fed to the wand assembly through hose 28. Operation of control valve 40 causes water to flow through hookup member 32, creating a suction in tube 34 that draws detergent from bottle 36, which is added in proper proportion to the stream of water flowing through hose 28. The liquid solution of water and detergent is dispensed from spray nozzle 42 mounted on head 41 onto the surface to be cleaned. A brush member 44 on head 41 works the dispensed liquid on the surface to loosen any dirt and to place the dirt into suspension in the liquid.

B. Source Water Hook Up

Figure 2:
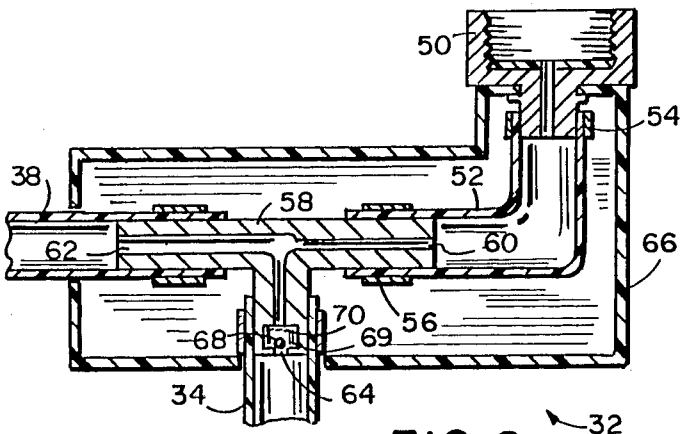
FIG. 2 is an enlarged sectional front elevational view of the liquid hookup device shown in FIG. 1.
Figure 3:
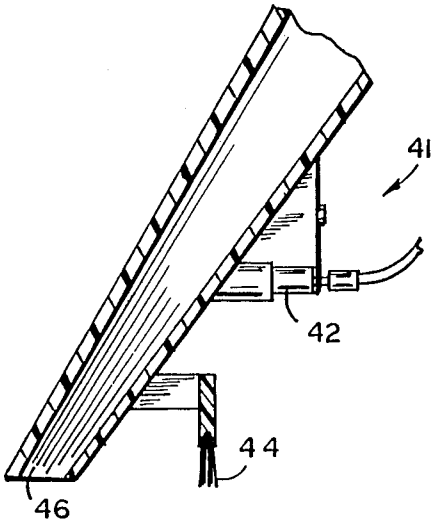
FIG. 3 is a sectional side elevational view along the lines 3—3 in FIG. 1.
Figure 5:
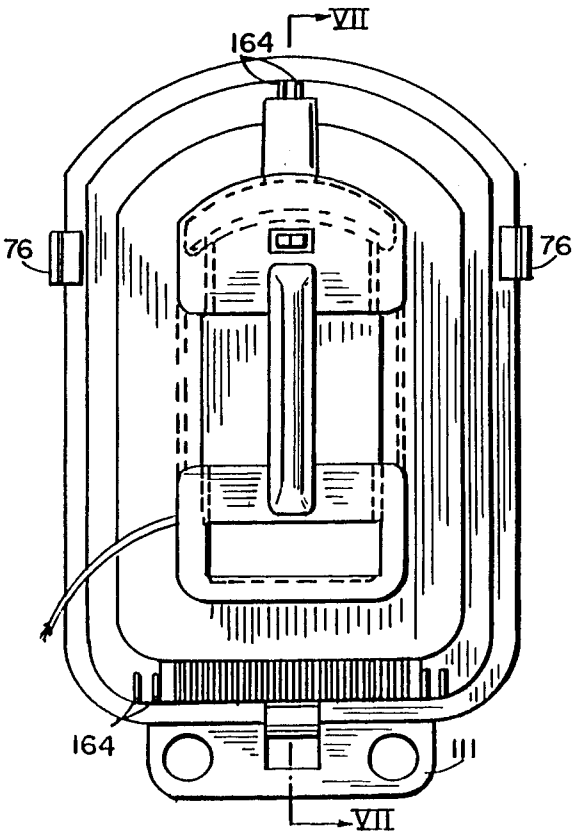
FIG. 5 is a top plan view of the canister assembly shown in FIG. 4.
Figure 6:
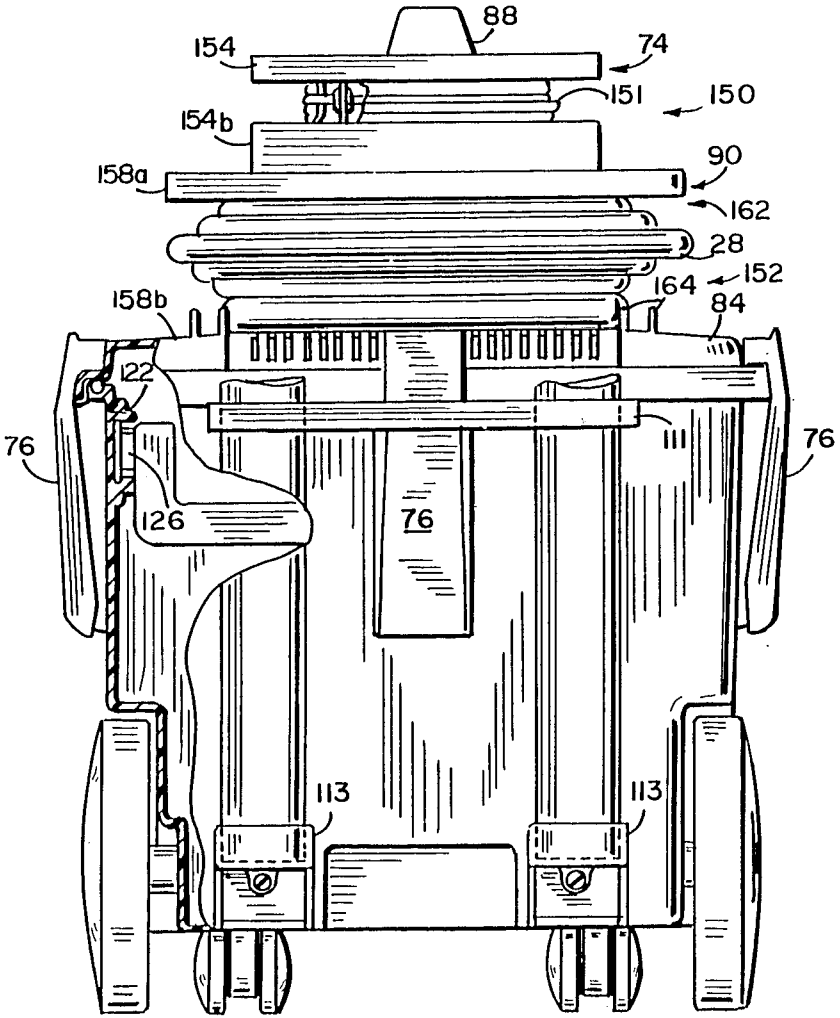
FIG. 6 is a rear elevational view of the canister assembly shown in FIG. 4.

Referring to FIG. 2, hookup member 32 is shown in detail. A fitting 50 is threaded so as to be threadably attachable to a faucet 30. A tube 52 is clamped to fitting 50 by a band clamp 54. A second band clamp 56 holds the opposite end of tube 52 to a siphon member 58.

Siphon member 58 is a T-connection having an inlet 60 connected to tube 52, an outlet 62 connected to hose 28 and a suction inlet 64 connected to suction tube 34. A housing 66 encloses the siphon member 58 and associated tubes and clamps.

A ball 68 is loosely fitted in a cage 69. As long as the user is actuating the control valve 40 and water is flowing through hose 28, a suction force is produced, drawing the detergent into the suction member 58. Ball 68 is elevated against stops 70 allowing the detergent to pass into the water stream. When the user releases the trigger 186 of control valve 40, the flow of water through hose 28 will stop and ball 68 will be forced against inlet 64 by the faucet water pressure to prevent water from squirting out of hose 34 into the detergent bottle.

In the illustrated embodiment, inlet 60 is thirty-thousandths of an inch in diameter and outlet 62 is fifty-thousandths of an inch in diameter. This enlargement at the intersection with suction inlet 64 helps to increase the suction force created by the water flowing from the faucet through member 58.

C. Recovery Tank, Tank Cover and Shutoff Valve

Referring now to FIGS. 4-10, the canister assembly 22 has a, recovery tank member 72 and a top member or cover 74. The top cover member is held engaged to the tank by latches 76 on opposite sidewalls and on the rear of the tank. A rubber O-ring or gasket 78 in a flange 80 provides a water and air seal between members 72 and 74.

Top member 74 has a top housing member 82, a base member 84 and a lower housing member 86. The members 82 and 86 are fastened to member 84 by screws 87.

Top housing member 82 has a carrying handle 88 formed in an upper portion for carrying the entire canister assembly 22. A lower portion 90 of top housing member 82 provides storage for the electrical power cord and the fluid hose 28 as will be described in detail below. Suction fan 92 and electrical motor 94 are concealed in the space between upper and lower housing members 82, 86. The suction side of fan 92 is connected to a suction opening 96 in the lower housing member and the opening is surrounded by a collar 98.

Recovery tank member 72 has a pair of opposing sidewalls 100, 102, a front wall 104, a rear wall 106 and a bottom 108. A pair of wheels 110 are located towards the rear of the recovery tank and a pair of swivel casters 112 are located at the front. An upper rail 111 and lower cups 113 hold disassembled sections of wand assembly 24 during storage of the entire apparatus.

A platform 114 extends upwardly from bottom 108 inside tank 72. Platform 114 serves as a base for mounting shutoff valve 117. Shutoff valve 117 includes a cage 116 having side openings 118 and a central top opening 115 therein. A spherically-shaped buoy or float 120 is retained within cage 116 and moves up and down therein with the level of fluid, in the recovery tank.

Cage 116, enclosing float 120, cooperates with collar 98 on the top member 74 of the canister to serve as a shutoff valve to prevent liquid from entering the suction fan 92. As the level of liquid rises in the recovery tank, float 120 will rise and eventually seat against collar 98. This seals the opening to the suction fan so that liquid cannot enter. The closing of opening 96 will cause the suction fan motor to noticeably increase in speed, and hence in noise emitted therefrom, to give an indication to the user that the recovery tank is in need of emptying.

When it is desired to empty the recovery tank, latches 76 are opened and top 74 is removed. Because cage 116 and float 120 remain a part of the recovery tank, all of the dirty liquid that tends to cling to these members will remain with the recovery tank. The components that are removed with the top will be relatively dry and hence will not be dripping dirty liquid onto the recently-cleaned surface. The curved front wall 104 of the tank, in combination with relatively planar sidewalls 100, 102 and rear wall 106 provide alignment means to assure that the top member 74 will be accurately positioned on tank 72. In this manner, upon replacing top member 74 on tank 72, collar 98 will be properly aligned with the top opening 115 in cage 116.

A pair of inwardly and rearwardly opening sockets 122 are attached to tank sidewalls 100, 102 by a conventional technique such as by heat staking. A molded plastic handle member 124 has mounting means that includes a pair of rotors 126 that are snap-fitted into and rotatable within sockets 122. Handle member 124 has a brace member 128 extending between rotors 126 and a grip member 130 spaced from the brace member and attached thereto by extension members 132.

As seen in FIG. 9, when it is desired to empty the recovery tank of dirty liquid, handle member 124 is rotated from a stored position to a vertical use position. Grip member 130 provides convenient means for lifting the tank with one hand. By inserting the opposite hand in an indent 134 in bottom wall 108 the user can conveniently tilt the tank for emptying After the tank is emptied, the handle 124 is rotated to a horizontal storage position completely within the recovery tank and straddling cage 116 in order to not interfere with operation of shutoff valve 117. A pair of rests 136 formed on sidewalls 100, 102 support the handle in a horizontal storage position.

The location of handle member 124 completely within recovery tank 72, when in its stored position, places this handle out of the way until it is needed for emptying the tank. The grip member extends outside of the tank when the handle is in the use position. This provides exceptional balance in lifting and tilting the recovery tank Advantageously, handle 124 with its brace member 128 serves the useful function of cross bracing, and hence restraining, the sidewalls 100, 102 against flexing. Because walls 100, 102 are relatively planar and of plastic construction they have a tendency to bow, especially when attempting to lift such a container by its top when full of liquid. The present invention resolves this problem with a simple and multi-functional solution.

D. Air and Liquid Separator

Suction hose 26 is connected at one end to wand 24 and to a, suction outlet 138 on top member 74 of canister 22 at the opposite end. As seen in FIGS. 7 and 10, suction outlet 138 leads through a circular orifice 140 to liquid and air separation chamber 142. Chamber 142 is a crescent-shaped device defined by an enclosed wall 143. Wall 143 defines an arcuately-shaped interior surface 144 opposite from orifice 140 and concave outwardly of chamber 142. A second arcuately-shaped interior surface 146 surrounds orifice 140, is concave inwardly of the chamber and is in a generally spaced apart parallel relationship with surface 144. A pair of end surfaces 148 span between adjacent lateral ends of surfaces 144 and 146.

As best seen in FIG. 7, wall 143 of the separation chamber 142 is vertically elongated and extends, through an extension 143*a*, substantially into the interior of recovery tank 72. Although wall 143 extends from suction outlet 138 down substantially into the recovery tank, the wall maintains its crescent shape and has a consistent lateral cross section, which is greater than the lateral cross section of orifice 140 which opens into chamber 142, throughout its entire longitudinal length. Chamber 142 is closed at its top and open at its bottom and is fabricated from plastic material.

Surface 144 of separation chamber 142 slopes laterally away from orifice 140. It is believed that surface 144 prevents foam from developing in the returned liquid by rapidly separating the fluid laterally and outwardly away from the air stream. The separated liquid gravitationally returns to the tank down end surface 148 while the air stream tends to move downward through the longitudinal center of the chamber 142 in a more direct path toward suction, opening 96. It is believed that once the liquid and air streams are separated, the creation of air pockets in the soapy liquid is less probable. This rapid separation is accomplished gently, i.e., without excessive agitation of the fluid mixture which could itself cause foaming, because the arcuate shape of the surface 144 provides a smooth transition in direction. Second wall 146 is believed to assist in diverting liquid that deflects toward it off of surface 144 in a generally lateral direction towards end surfaces 148.

E. Cord and Hose Storage

Lower portion 90 of top or cover member 74 provides a first spool 150 for wound storage of the electrical cord 151 that provides electrical power to the fan motor 94 from a house outlet (not shown), and a second spool 152, concentric with the first, for wound storage of fluid hose 28. First spool 150 has end members 154*a*, 154*b* and a core 156. Second spool 152 has end members 158*a*, 158*b* and a core 160.

The convenient location of first spool 150 and top member 74 allows one end of electrical cord 151 to penetrate top housing member 82 to supply motor 94. When apparatus 2 is not in use, electrical cord 151 is wound around first spool 150.

Unlike electrical cord 151, fluid hose 28 is not permanently connected at either end to canister 22. A first end terminates in hookup member 32 and the opposite end connects to fluid control valve 40 on wand 24. Fluid hose 28 is provided in a substantially long length in order to allow apparatus 20 to be used at locations far remote from a faucet. There will be other applications, however, where apparatus 20 will be used relatively close to a faucet 30. For these latter situations, second spool 152 is provided with means for facilitating selective access to both ends of the fluid hose 28, so that they may be unwound, while allowing a portion of the hose to remain stored on the spool. This is accomplished by endowing spool 152 with a winding area 162 that is substantially larger than that required for storage of the hose 28. Accordingly, hose 28 can be wound with a mid-portion started in a vertically central portion of area 162 and one end of hose 28 wrapped in a spiraling upwardly fashion while the other end wrapped in a spiraling downwardly fashion. In this manner, both ends can be selectively unwound only to the extent necessary for the particular application. The rest of hose 28 can remain conveniently wound on the spool.

Multiple pairs of upstanding members 164 are located around the perimeter of base member 84. Members 164 are spaced apart in each pair a distance slightly less than the diameter of fluid hose 28 and serve as retainers through which an end of the hole can be placed, after being partially unwrapped from the spool 152, to prevent further unravelling. The provision of multiple pairs of the members 164 will allow both ends of hose 28 to be held in place and will allow the ends to face in various directions with respect to the canister assembly 22. Conveniently, the crescent shape of separator chamber 142 conforms to the curved shape of core 160 and therefore contributes to the compact and utilitarian, as well as the aesthetic, configuration of the canister assembly 22.

F. Control Valve and Handle

Figure 12:
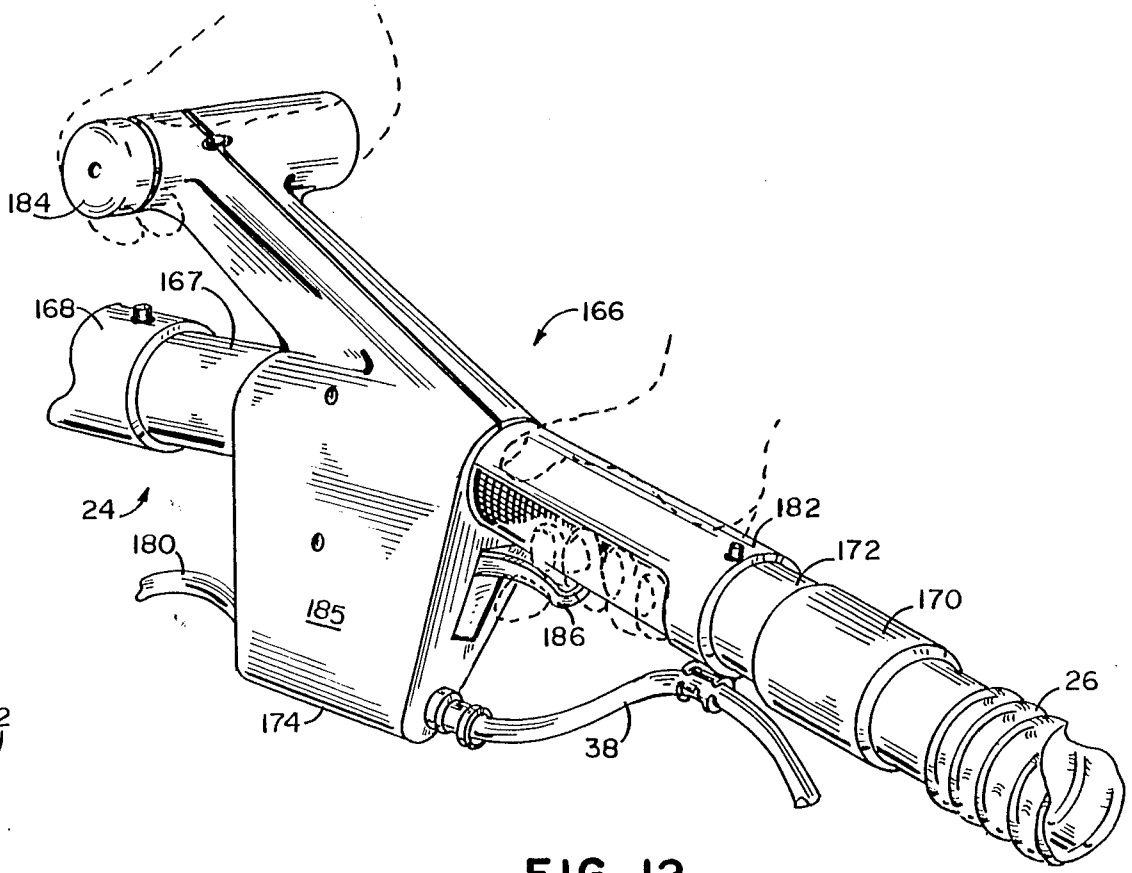
FIG. 12 is a perspective view of the handle portion of the wand assembly.
Figure 14:
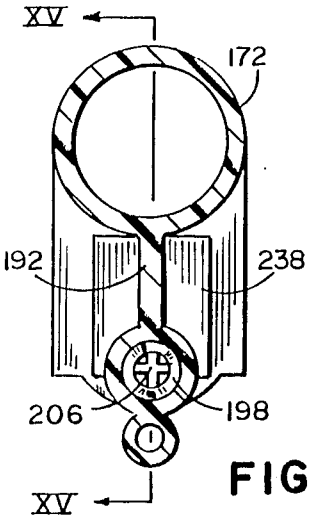
FIG. 14 is a sectional front elevational view along the lines 14—14 in FIG. 13.

Referring now to FIG. 12, wand assembly 24 is seen to have an operating handle member 166. A front connector 167 of handle 166 is connected to a rigid tube 168 that extends to suction nozzle 46. A connector 170 at the rear of handle 166 connects to suction hose 26. A hollow tube 172 extends through handle 166 between connectors 167 and 170. A control valve assembly 174 extends downwardly from handle 166 and has an affluent fitting 176 and an effluent fitting 178. Affluent fitting 176 connects to portion 38 of fluid hose 28. Effluent fitting 178 connects to a hose 180 extending to spray nozzle 42.

Handle 166 further has a first grip portion 182 and a second grip portion 184. A trigger 186 directly below grip portion 182 provides user actuation of control valve assembly 174, as will be described below. A cover 185 conceals most of the control valve assembly. Substantially all of the above components are formed from plastic material.

Control valve 174 has a base 188 extending integrally from handle member 166 and a control valve 190 attached to a first portion 192 of base 188 (FIG. 15). Trigger 186 is attached to a second portion 194 of base 188, in a manner that will be explained, and is attached to valve member 190 by attachment means generally shown at 196.

Valve member 190 has a horizontal oriented barrel shown at 198 which is covered at one end by a resilient seat 200. Seat 200 has a passage 202 in its center for passage of fluid therethrough. A valve head 204 longitudinally reciprocates in barrel 198 between a first position contacting the seat 200, to close passage 202 to fluid flow, and a second position spaced from seat 200 to allow fluid flow through passage 202. An elongated stem 206 in barrel 198 has a first end portion attached to head 204 and a second end portion 208. Portion 208 is flattened and has a pair of studs 210 extending in opposite directions laterally therefrom. A spring 212 surrounds stem 206 and biases it towards the first, closed position. An O-ring 211 surrounds stem 206 to prevent liquid from escaping between second end portion 208 and barrel 198.

Second portion 194 of base 188 has a generally horizontal throat 214 extending longitudinally away from the base first portion 192. Throat 214 has a rounded inner end portion 216 and a downwardly opening mouth portion 218. Second portion 194 further has a downwardly extending portion 220 that terminates in a flange 222 which, in turn, terminates in an upturned outer lip 224.

Figure 16:
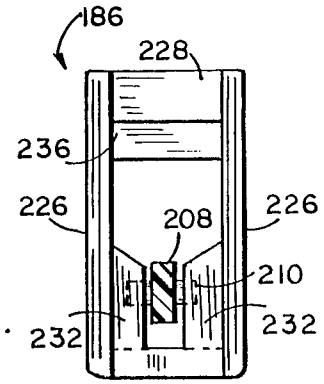
FIG. 16 is a sectional front elevational view along the lines 16—16 in FIG. 15.
Figure 13:
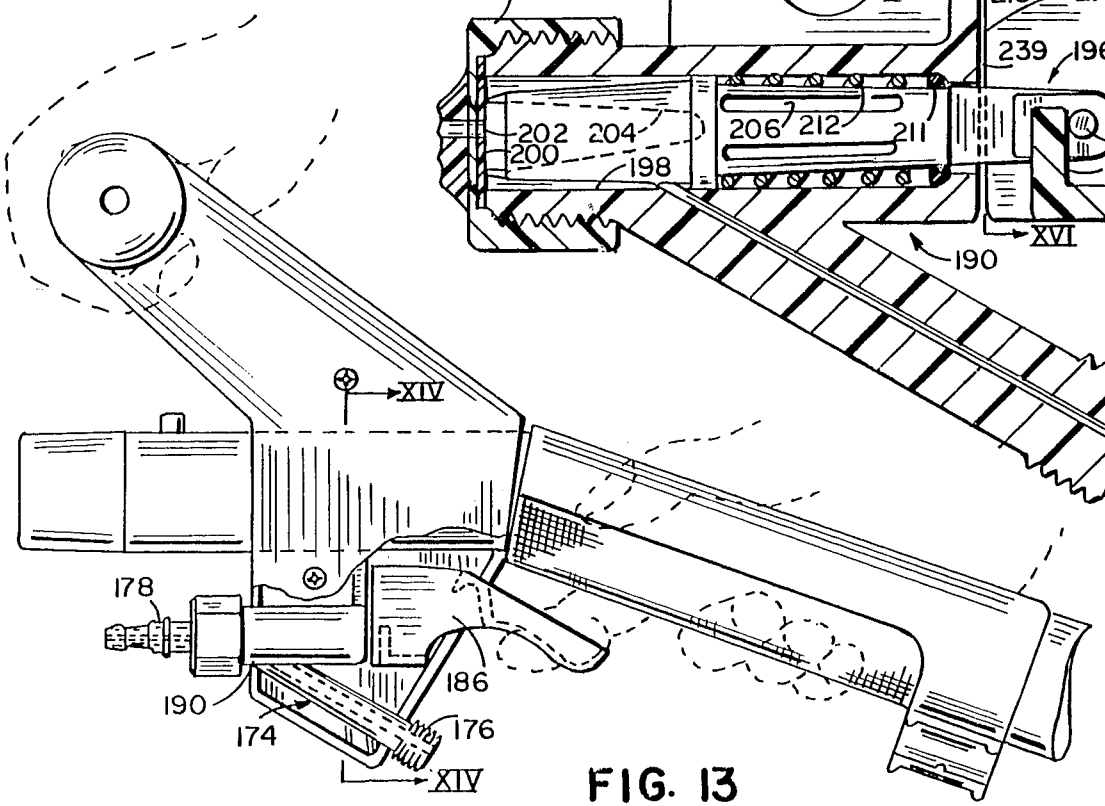
FIG. 13 is a side elevational view of the handle shown in FIG. 12 with a portion of the cover removed.

Trigger 186 has a pair of spaced apart parallel sidewalls 226 and a pin 228 and actuating portion 230 spanning the sidewalls 226 (FIG. 16). A pair of fingers 232 at a lower portion of trigger 186 are spaced apart the width of second end portion 208 of stem 206. Fingers 232 straddle end portion 208 and abut studs 210 to provide attachment means 196 with the valve member 190. Pin 228, which has an arcuate surface configured the same as inner end portion 216, is rotatable within throat 214. Actuating portion 230 terminates forwardly in a flange 234 which itself terminates in a downturned outer lip 236. Flange 234 and lip 236 overlap flange 222 and lip 224 on the base second portion. A member 238 defines a planar surface on first portion 192 that is adjacent to, and may abut, a planar surface 239 of trigger 186 when the trigger is not actuated.

In operation, an upward force on actuating portion 230 by a user's finger will cause trigger 186 to pivot about pin 228 rotating against inner end portion 216 of throat 214. Fingers 232 will move generally to the right, as viewed in FIG. 15, and in turn, contact studs 210 and move stem 206 to the right. This will cause head 204 to move from its first, closed position to its second, open position. Fluid entering affluent fitting 176 will flow through barrel 198 and through passage 202 out effluent fitting 178. When the user releases the grip on actuating portion 230, the biasing force of spring 212 will move the valve to the closed position and rotate the trigger clockwise, as viewed in FIG. 15. The interaction of overlapping flanges 222, 234 and lips 224, 236, along with attachment means 196 and pin 228 in throat 218, prevents the trigger from coming loose or disassembled from portion 194.

The above-described control valve assembly, with the exception of spring 212 is entirely molded from plastic materials and hence is inexpensive to manufacture. In addition, the valve assembly can be assembled without the use of separate fasteners and results in a securely assembled, smoothly operating mechanism.

Assembly of control valve 174 is as follows Spring 212 is placed over stem 206 and the stem is placed in the barrel 198 from the left, as viewed in FIG. 15. An object such as a dowel is used to exert a force against head 204 in order to compress the spring 212. With spring 212 compressed, pin 228 is positioned in throat 214 through mouth portion 218. Simultaneously, downturned lip 236 on the trigger is moved up and over upturned lip 224 of portion 220. Also, simultaneously, fingers 232 are slid to the left of studs 210 into their straddling relationship with end portion 208. The pressure exerted by the dowel is then released. Spring 212 will force the stem and head of the valve to the left, to their first position This biasing force will hold pin 228 securely within throat 214 and will keep lips 234 and 236 in their overlapping interlocked orientation. Finally, effluent fitting 178 having seat 200 inserted therein, is threaded onto threads of valve member 190 and into contact with head 204.

To disassemble the control valve assembly these steps are repeated in the reverse order. While the assembly of the valve is simple and straightforward, the final assembly will be stable and not subject to coming apart unless fitting 178 is removed and an instrument is used to compress spring 212.

G. Conclusion

Thus, the present invention in its various aspects provides a liquid extraction surface cleaner that is inexpensive to manufacture, lightweight, compact, easy to set up and use and easy to clean up without a mess. To use, the operator unwraps the fluid hose 28 and electrical power cord from their respective spools 150 and 152 on removable cover 74 and connects hookup member 32 to a conventional faucet outlet. The operator activates trigger 186 of control valve assembly 174 and water is free to flow through fluid hose 28, drawing detergent from bottle 36 through hose 34 into hose 28. This detergent solution flows to the spray nozzle 42 on dispensing and pickup head 41 at the end of wand assembly 24, where it is sprayed onto the surface to be cleaned, and is picked up by vacuum nozzle 46 on head 41 at the end, of wand assembly 24.

The vacuum created by suction fan 92 located in cover 74 draws air and liquid into the recovery tank, through air and water separator 142 which minimizes foam formation in recovery tank 72. Shutoff valve 117 located within recovery tank 72 prevents liquid from rising so high as to enter suction fan 92. However, shutoff valve 117's location within tank 72 rather than as an attachment to cover 74 keeps dirty water from dripping off cover 74 when it is removed to empty tank 72.

Tank 72 can be conveniently emptied by rotating handle 124 to an upright position and using it to lift tank 72 to a sink, toilet or the like. Handle 124 also gives structural rigidity to tank 72.

Of course, it is understood that the above is merely a preferred embodiment of the invention. Changes and modifications in the specifically described embodiments can be carried out without departing from the scope of the invention, which is intended to be limited only by the scope of the appended claims and all equivalents to which we are entitled as a matter of law.

The embodiments of the invention in which an exclusive property or privilege is claimed are defined as follows.

1. A liquid extraction apparatus comprising:

a tank having wall means defining an opening said opening providing the primary means for emptying said tank of contents therein;

a cover selectively closing said opening, said cover being removable from said opening in order to empty said tank of the contents;

suction means mounted in said cover for producing a stream of air at a sufficiently high negative pressure to pick up liquid from a surface;

pickup means operably connected to an in flow communication with said tank whereby liquid is drawn by said suction means from said surface into said tank;

suction inlet means in said cover whereby said suction means communicates with the interior of said tank;

handle means positioned in said tank in a manner that said tank may be elevated with one hand without spilling the contents thereof, whereby said handle means is accessible by removing said cover; and shutoff valve means in said tank for covering said inlet means when liquid in said tank reaches a predetermined high level, said shutoff valve means being mounted to said tank wall means and free of attachment to said cover and adapted to remain mounted to said tank wall means while said cover is removed whereby when said cover is removed said handle means may be accessed and said tank may be emptied of its contents by elevating the tank with one hand and pivoting the tank about said one hand with the other hand, and said shutoff valve remains in said tank and does not drip liquid onto whatever surface said cover is removed to.

2. The apparatus in claim 1 further having means for orienting said cover over said opening so that said suction inlet means will be aligned with said shutoff valve means when said cover is over said opening.

3. A liquid extraction apparatus comprising:

a tank having wall means defining an opening;

a cover selectively closing said opening;

suction means mounted in said cover for producing a stream of air at a sufficiently high negative pressure to pick up liquid from a surface;

pickup means operably connected to and in flow communication with said tank whereby liquid is drawn by said suction means from said surface into said tank;

suction inlet means in said cover whereby said suction means communicates with the interior of said tank; and shutoff valve means in said tank for covering said inlet means when liquid in said tank reaches a predetermined high level, said shutoff valve means being free of attachment to said cover, whereby when said cover is removed said shutoff valve remains in said tank and does not drip liquid onto whatever surface said cover is removed to, said shutoff valve means being mounted to said tank and comprising a cage having means defining side openings and a top opening in said cage and a float inside said cage configured to close said suction inlet means when in contact therewith; and means for orienting said cover over said opening so that said suction inlet means will be aligned with said shutoff valve means when said cover is over said opening.

4. The apparatus in claim 3 wherein said suction inlet means is a circular collar and said flat is spherically shaped.

5. The apparatus in claim 4 further having handle means positioned in said tank for facilitating a user lifting said apparatus and mounting means for rotatably mounting said handle means to opposing portions of said wall means, said handle means having an attachment portion attached to said wall means by said mounting means and a grip portion including extension means for interconnecting said grip portion with said attachment portion wherein said handle means grip portion is rotatable between a generally horizontal storage position and a generally vertical use position.

6. The apparatus in claim 5 wherein said handle extension means straddles said shutoff valve when in said stored position.

7. A liquid extraction apparatus comprising:

a tank having wall means defining an opening;

a cover selectively closing said opening;

suction means mounted in said cover for producing a stream of air at a sufficiently high negative pressure to pick up liquid from a surface;

pickup means operably connected to and in flow communication with said tank whereby liquid is drawn by said suction means from said surface into said tank;

suction inlet means in said cover whereby said suction means communicates with the interior of said tank; and shutoff valve means in said tank for covering said inlet means when liquid in said tank reaches a predetermined high level, said shutoff valve means being free of attachment to said cover, whereby when said cover is removed said shutoff valve remains in said tank and does not drip liquid onto whatever surface said cover is removed to, said shutoff valve means being mounted to said tank wall means and including a cage having means defining side openings and a top opening in said cage and a float inside said cage configured to close said suction inlet means when in contact therewith.

8. The apparatus in claim 8 wherein said suction inlet means is a circular collar and said float is spherically shaped.

9. The apparatus in claim 9 further having handle means positioned in said tank for facilitating a user lifting said apparatus and mounting means for rotatably mounting said handle means to opposing portions of said wall means, said handle means having an attachment portion attached to said wall means by said mounting means and a grip portion including extension means for interconnecting said grip portion with said attachment portion wherein said handle means grip portion is rotatable between a generally horizontal storage position and a generally vertical use position.

10. The apparatus in claim 9 wherein said handle extension means straddles said shutoff valve when in said stored position.

* * * * *

UNITED STATES PATENT AND TRADEMARK OFFICE

CERTIFICATE OF CORRECTION

PATENT NO. : 4,847,943

DATED : July 18, 1989

INVENTOR(S) : Michael R. Blase, Henry J. Rosendall and Gordon W. Goodrich

It is certified that error appears in the above-identified patent and that said Letters Patent is hereby corrected as shown below:

Column 1, Line 41:

After "chamber" insert --.--

Column 1, Line 47:

After "chamber" insert --.--

Column 3, Line 33:

"ward" should be --wand--

Column 5, Line 29:

After "tank" insert --.--

Column 6, Line 29:

"apparatus 2" should be --apparatus 20--

Column 6, Line 58:

"hole" should be --hose--

Column 10, Claim 4, Line 23:

"flat" should be --float--

Column 10, Claim 8, Line 64:

"claim 8" should be --claim 7--

UNITED STATES PATENT AND TRADEMARK OFFICE

CERTIFICATE OF CORRECTION

PATENT NO. : 4,847,943

DATED : July 18, 1989

INVENTOR(S) : Michael R. Blase, Henry J. Rosendall and Gordon W. Goodrich

It is certified that error appears in the above-identified patent and that said Letters Patent is hereby corrected as shown below:

Column 10, Claim 9, Line 67:

"claim 9" should be --claim 8--

Signed and Sealed this

Seventh Day of August, 1990

*Attest:*

HARRY F. MANBECK, JR.

*Attesting Officer*

*Commissioner of Patents and Trademarks*